United States Patent [19]

Gyldén et al.

[11] 4,336,209

[45] Jun. 22, 1982

[54] PROCESS AND DEVICE FOR PREPARING CAST EXPLOSIVE BODIES

[76] Inventors: Nils O. Gyldén, Ceremonimästarvägen 81, S-181 40 Lidingö; Nial T. Karlén, Olovsvägen 19, S-147 00 Tumba; Jarl B. E. Andersson, Söderby Kvarn 2503, S-137 00 Västerhaninge; Anders G. T. Andersson, Granbacken 12, S-147 00 Tumba, all of Sweden

[21] Appl. No.: 46,166

[22] Filed: Jun. 7, 1979

[30] Foreign Application Priority Data

Jun. 9, 1978 [SE] Sweden ..... 7806744

[51] Int. Cl.[3] ..... C06B 21/00

[52] U.S. Cl. ..... 264/3 R; 102/476; 86/20 B

[58] Field of Search ..... 86/20 B, 20 D; 264/3 R; 102/476

[56] References Cited

U.S. PATENT DOCUMENTS

| | | | |
|---|---|---|---|
| 2,897,714 | 8/1959 | Précoul | 86/20 D |
| 3,722,354 | 3/1973 | Herty | 264/3 R |

FOREIGN PATENT DOCUMENTS

| | | | |
|---|---|---|---|
| 1089677 | 9/1960 | Fed. Rep. of Germany . | |
| 1113890 | 9/1961 | Fed. Rep. of Germany . | |
| 1912500 | 11/1970 | Fed. Rep. of Germany | 86/20 B |
| 1956989 | 5/1971 | Fed. Rep. of Germany . | |
| 175369 | 5/1961 | Sweden . | |

OTHER PUBLICATIONS

Schall et al., "Nobel Hefte", H-4, 28, pp. 133-143 (1962).

"Explosivstoffe", 8, pp. 1-4 (1960).

*Primary Examiner*—Edward A. Miller

*Attorney, Agent, or Firm*—Fleit & Jacobson

[57] ABSTRACT

Explosive bodies for use in hollow-charges are produced by casting a mixture of solid, particulate explosive material dispersed in melted explosive material. The sedimentation of solid explosive in melted explosive is carried out in an undisturbed manner in the mould, i.e. without being influenced by convection currents within the mixture or by collision with the walls of the mould, giving rotationally symmetrical explosive bodies. The detonation front deviation from nominal shape does not exceed 0.05 percent of the body diameter in case of rotationally symmetrical initiation of detonation of the produced explosive body.

7 Claims, 2 Drawing Figures

PROCESS AND DEVICE FOR PREPARING CAST EXPLOSIVE BODIES

Figure 1:
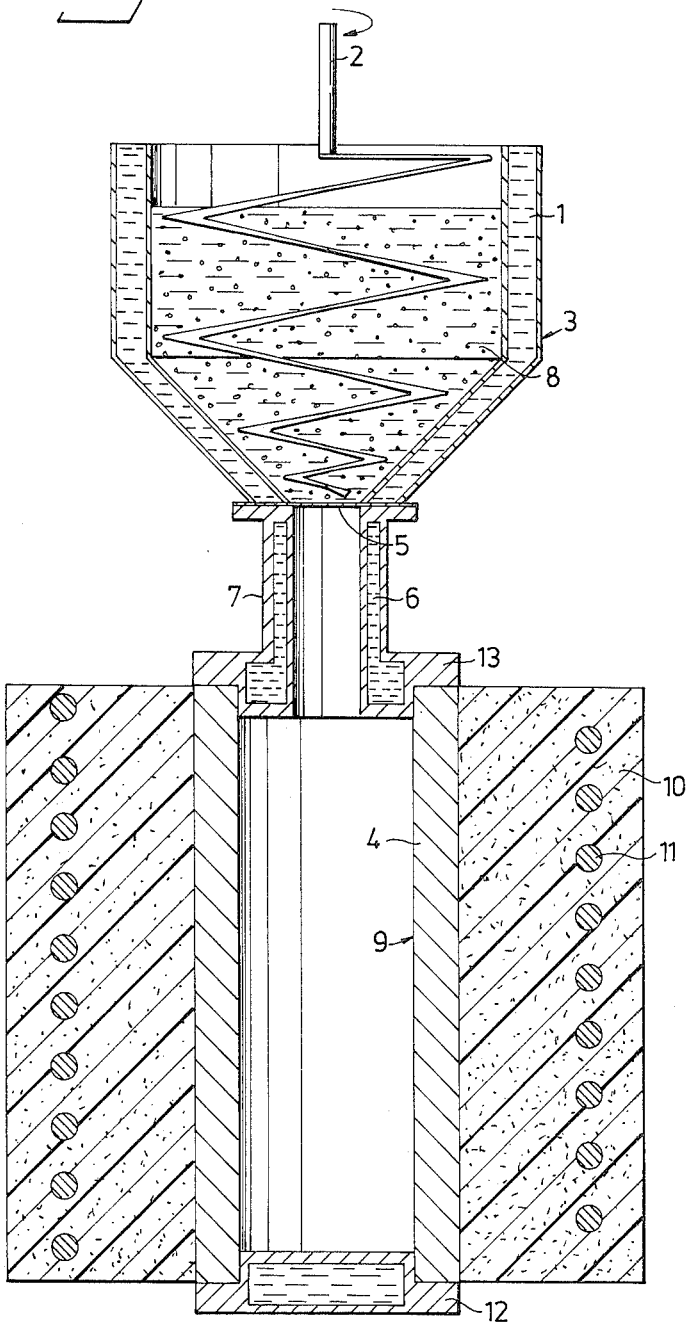

This invention relates to the production of rotationally symmetrical explosive bodies, i.e. bodies that are symmetrical about the axis of rotation, to be used in hollow-explosive charges.

Hollow-explosive charges are based on the principle that a hydrodynamical flow condition is obtained when a metal part in the form of a thin-walled conical liner is pressed together in a rotationally symmetrical way by the high pressure from detonating explosive material. As a result, the metal is caused to flow as a liquid, giving a metal jet which because of its enormous speed (about 10 km/s) is able to force its way through an armouring of a thickness of 0.3–0.6 m, a typical thickness for the usual type of ammunition.

A condition for said functioning and effect of a hollow-explosive charge is that its details, including the explosive body, are built in a symmetrical way about the axis of rotation. Even small deviations from rotation symmetry will cause a considerable reduction of the penetration ability. This is realized when considering the functioning principle, according to which the kinetic energy that is produced at the detonation of the explosive, is directed and concentrated to a small area.

The penetration does occur in such a way that the target material is pressed apart by the pressure that is obtained when it is hit by the jet, and the resulting hole is made deeper and deeper while at the same time the jet itself is used up. This is possible only if every part of the jet is gradually getting down into said hole and is made to work upon the bottom of that hole section that has been made by the just previous part of the jet. The hole in the target material is narrow, typically with a diameter of 10–15 mm, and it is obvious that there must be narrow tolerances for the deviation of the jet from the symmetry axis of the charge.

It is previously believed that appearing variations of jet penetration are dependent on variations in the geometrical dimensions of the hollow-explosive charge. Since long one has had a good understanding of the geometrical tolerance demands on the details of vital importance, primarily on the liner, the so called metal cone, as regards variations in material thickness, ovality, obliqueness in alignment etc. Despite better methods of manufacturing large deviations in the jet character have, however, been obtained. Not until the last years has one realized that occuring variation can also be caused by lacking homogeneity within the explosive body.

Thus, in order to enhance the directing effect of the charge, it is not sufficient with careful mechanical working of details contained therein but the mass of material constituting the explosive body must also be utterly homogeneous or at least symmetrical about the axis of rotation. Deviations from the explosive body nominal detonation qualities as a consequence of its internal construction must be given tolerance demands as well as the geometrical measures.

A good idea of the explosive body quality in said respect is obtained if the deviation from nominal shape of the explosive detonation front is measured with a suitable method when said detonation front reaches the liner. Quantitatively such experiments will give the information that if one wishes to produce a hollow-explosive charge whose penetration ability is almost as great as is theoretically possible, the working of the vital details must be performed with dimension tolerances of the same magnitude as is used at the manufacture of for instance the vital details of a car engine, and the deviation from nominal shape of the detonation front must not exceed 0.05 percent or 0.5 per mille of the charge caliber.

The present invention relates to a process of precision preparation of rotationally symmetrical explosive bodies for hollow-explosive charges by casting an explosive material mixture comprising a liquid melted phase of one or more meltable explosives (e.g. TNT, i.e. trinitrotoluene or trotyl), in which liquid phase there are dispersed one or more solid explosives of a density that is higher than that of the liquid phase (e.g. RDX and/or HMX in the form of larger and/or smaller granules). RDX is short for trimethylene trinitramine or hexogen and HMX is short for tetramethylene tetranitramine or octogen.

It is a casting technical problem how to make said mixture solidify into a solid body free from cracks and pores, or into a body in which possible pores are distributed in a rotationally symmetrical way, and also how to obtain a uniform distribution of the originally solid phase or phases, in order to get such a sufficiently good symmetry within the explosive body that the shape of the detonation front will not deviate from nominal shape more than 0.05 percent of the body diameter provided that the initiation of the explosive is rotationally symmetrical.

According to the invention said problem is solved by subjecting the explosive material mixture to the following steps:

(a) said dispersion of solid phases in the liquid phase is homogenized by means of sufficiently powerful and long stirring using appropriately designed agitators and stirring vessels and under such vacuum that moisture and adsorbed gases will disappear to a sufficient degree;

(b) the homogenized mixture is transferred to a casting mould so quickly that no appreciable sedimentation of solid phase will have time to occur before the mixture has come to rest in the mould; in another embodiment of the invention the agitator is so quickly removed from the stirring vessel (also functioning as a casting mould) that no appreciable sedimentation will have time to occur before the mixture has come to rest;

(c) the solid phases are allowed to settle in an undisturbed way to a steady state, in which the granules have come to rest from the bottom of the mould and up to a height which at least corresponds to the height of the final explosive body; undisturbed settling or sedimentation means that the granules of higher density are allowed to sink freely in the liquid phase of lower density without being influenced by other forces than gravity, which means absence of for instance forces from vibration, forces caused by collision with walls in the mould or forces caused by convection currents resulting from temperature differences between different parts of the mixture and/or the mould;

(d) the solidification of the mixture is controlled so that the solidification front becomes rotationally symmetrical and is made to move continuously from the bottom/walls of the mould and upwards/inwards in such a way and so slowly that the melted phase despite the solidification shrinkage will have time to fill the cavities between the granules without moving the granules from their previous positions in order that a body free from pores will be obtained or that possible pores will be distributed within the body in a rotationally symmetrical way;

(e) the cooling of the solidified body to room temperature is controlled in such a way and performed so slowly that thermal stresses are allowed to gradually become released through plastic flowing which results in a body free from cracks;

(f) the cooled body is then machined so that desired dimensions are obtained, which includes removal of the upper part of the body (the so-called lost head) and machining of the recess for the liner (the metal cone). It is previously known to produce explosive bodies for hollow-explosive charges by means of casting. After melting in a vessel provided with a water jacket and agitator and transfer to a mould, the sedimentation process has generally been allowed to proceed uncontrolled which has given an irregular result, depending on the fact that a certain amount of sedimentation has occurred already before the melt has come to rest in the mould and also depending on an irregular emission of heat. The result is also depending on how the pouring into the mould has been done. With the present invention there is obtained a method of casting explosive bodies for hollow-explosive charges that is independent of the actual pouring of the melt into the mould.

In order to obtain a better, more regular result from the casting process, i.e. in order to avoid inhomogeneities, pores and cracks in prepared castings, one has previously used among other things vibration and centrifugal casting without obtaining satisfying tolerances as to the variation of the penetration ability of the jet from the hollow-charge.

With the present invention it is possible to make crack-free castings for hollow-explosive charges with a uniform distribution of originally solid phases and rotationally symmetrical distribution of possible pores which not only improves the penetration ability of the jet but also reduces the variation in qualities between individual charges.

According to the invention the explosive material mixture is cast in an outwardly insulated mould with vertical walls made of a material of good thermal conductivity, the wall material being defined outwardly and inwardly by surfaces that are concentrical. The mould is preferably a right circular cylinder with a vertical axis. The mould is provided with a top head and a bottom head, each being connected to adjustable sources of heat, and so arranged that the top head and bottom head respectively will at any time have a uniform temperature over the entire surface that is facing the interior of the mould. With the described arrangement there is obtained in the mould wall a temperature field with a temperature gradient in the axial direction being constant. Said temperature field is always symmetric about the axis of rotation and concentric with the mould wall. If the top head and the bottom head are given the same temperature there is obtained a uniform temperature distribution in all of the internally defining surfaces of the mould, i.e. walls, bottom head and top head.

When the explosive material mixture is cast in a mould arranged in the described way, the earlier stated conditions for obtaining a rotationally symmetrical explosive body are fullfilled, as follows:

Because of the mould walls being vertical the sedimentation, i.e. the vertical sinking of the solid phases, will occur without being disturbed by collisions with the walls. And because of a uniform temperature distribution being maintained in the walls, bottom head and top head of the mould during the sedimentation process, there is achieved thermal equilibrium between the different parts of the explosive mixture so that the vertical sinking of the solid phases will proceed without disturbance from convection currents within the mixture.

This causes the sedimentation to result in a uniform distribution of the originally solid phases in the lower part of the casting (the upper part is removed and discarded). By maintaining a rotationally symmetrical temperature field in the mould during the solidification process, the solidification front will become rotationally symmetrical which makes possible pores to be distributed in the casting in a rotationally symmetrical way.

Preferably the same temperature namely a few degrees above the melting temperature of the meltable substance, is maintained during stirring, transfer into the mould and sedimentation by means of good insulation and water jacketing with high water speed, the temperature being supervised by for instance thermocouples connected to different parts of the mould wall.

Figure 2:
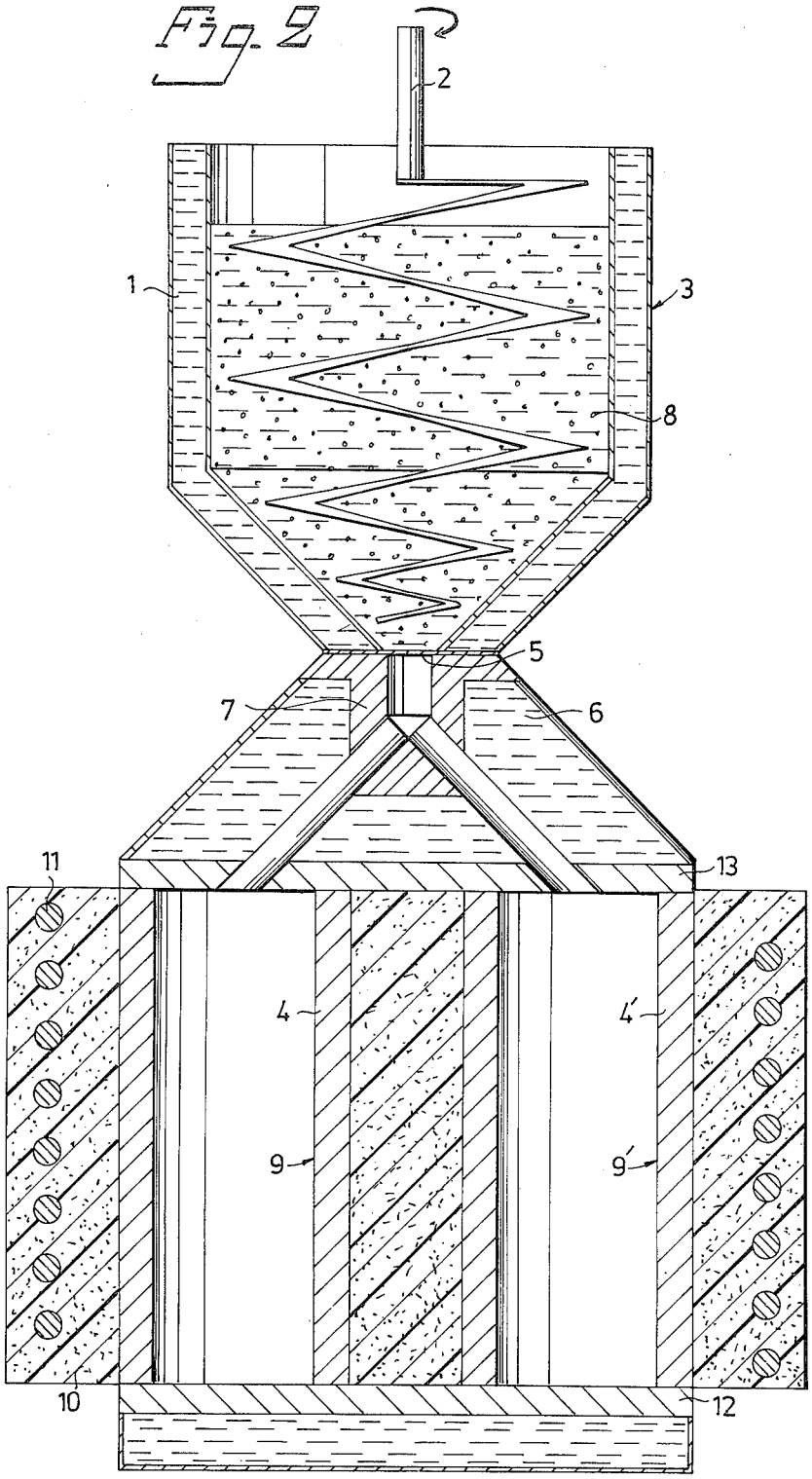

The invention will now be described in more detail for an illustrating but not delimiting purpose with reference to the attached drawings, in which FIG. 1 is a somewhat schematic, sectional view of a casting device according to the invention; and FIG. 2 shows another embodiment of the invention where the casting is performed in two moulds at the same time.

In a vessel 3 provided with a hot water jacketing 1 and an agitator 2 there is melted a mixture 8 of meltable TNT and solid, granular RDX of a particle size of 10–500 microns, e.g. 35–40 percent by weight of TNT and 60–65 percent by weight of RDX. The mixture of solid RDX particles in melted TNT is stirred effectively, the shape of the agitator being adapted to the shape of the vessel. A suitable vacuum in the vessel 3 is adjusted so that moisture and adsorbed gases will disappear to a sufficient extent.

The stirring vessel 3 is directly connected to an evacuated casting mould 4 via a transfer means 7 including a disruptable membrane 5 and a hot water jacketing 6. The water systems 1 and 6 may be coupled in series or in parallel or constitute two separate systems. A slight overpressure in the vessel 3 will disrupt the membrane 5 with the result that the homogenized mixture 8 will be transferred to the mould 4 so quickly that there is no time for sedimentation of solid phase before the mixture has come to rest in the mould 4.

As an alternative the vessel 3 is also the mould in which case, after homogenization of the mixture 8, the agitator 2 is removed from the vessel 3 so quickly that no appreciable sedimentation will occur until the melt has come to rest.

The mould 4 is surrounded by an insulation 10 of for instance foam plastic, rendering the heat exchange with the environment more difficult. It is made of a well heat-conducting metal, e.g. copper, of heavy material thickness, and the walls 9 thereof are defined outwardly and inwardly by surfaces forming concentrical, right circular cylinders with a vertical axis. The mould is provided with a top head member 13 and a bottom head member 12 of heavy material thickness made of a well heat-conducting metal, comprising concentrically arranged water jackets connected to heaters and pumps giving a rapid flow of hot water. The water temperature can be accurately controlled. The temperatures of the top head member 13 and the bottom head member 12 may be regulated separately from each other, and the described arrangement is such that each head member in every moment has a uniform temperature over its entire surface facing the interior of the mould.

In or around the insulation layer 10 there is placed a heating coil 11, whose heat emission is so adapted that it will just compensate the heat loss from the mould 4 towards the environment as a consequence of the imperfect insulating ability of the insulation layer.

The same temperature is maintained in the entire system during the steps of stirring the mixture and transfer thereof to the mould and also during the whole sedimentation process, namely a temperature just above the melting point of TNT, about 82° C.

The temperature difference between different parts of the mixture is supervised for instance by means of thermo-couples connected to different parts of the mould wall. The temperature difference must be kept within very narrow limits, suitably less than ±0.1° C.

Thus, the sedimentation of solid phase does occur undisturbed from collision with the walls as well as from convection currents caused by temperature differences, and the distribution of solid phase becomes uniform within the lower, utilized part of the explosive body.

When steady state is reached, a controlled solidification of the mixture 8 is carried out by slowly lowering the temperature in the bottom head member 12 of the mould, for instance with 1.5° C./h. After 2–3 h the temperature in the top head member 13 is also lowered in a corresponding way, i.e. slowly, for instance with 1.5° C./h. Heat is thus removed via the top head member and the bottom head member of the mould with the result that the solidification front becomes rotationally symmetrical and is caused to move continuously upwards/inwards from the bottom/walls of the mould. As the solidification occurs very slowly, there is sufficient time for the melted phase of TNT to fill the cavities between the granules. Possible pores will become distributed in a rotationally symmetrical manner within the body.

When the body has become solidified, it is brought to room temperature by means of a controlled, slow cooling, with for instance 3° C./h.

The cast body is taken out of the mould, the upper part (the so-called lost head) is removed, and the body is machined to give it desired dimensions and preparation of the recess for the liner.

The casting process of invention may also be carried out in two or more parallel moulds. In FIG. 2 there is shown a device comprising two moulds 4,4'. The device is then given a correspondingly increased production capacity.

The invention is thus not limited to the shown and described embodiments but a great number of modifications thereof are possible within the scope of the appended claims.

What is claimed is:

1. A process for preparing an explosive body shaped as a right circular cylinder by vacuum casting of an explosive material mixture comprising a liquid, melted phase, and solid components having a higher density than the liquid phase and dispersed therein, said process comprising:

homogenizing the explosive material mixture and introducing the mixture into an insulated mould having a flat bottom head member and vertical walls symmetric about a longitudinal axis of the mould;

maintaining a uniform temperature over the entire surface of the flat bottom head member facing the interior of the mould;

maintaining in the vertical walls a temperature field having a temperature gradient constant in the axial direction and symmetric about the mould axis whereby thermal equilibrium is achieved between different parts of the explosive mixture so that sedimentation occurs without disturbance from convection currents within the mixture; and slowly lowering the temperature in the bottom head member to obtain controlled solidification of the mixture.

2. The process of claim 1, wherein the insulated mould has a top head member closing the top of the mould and wherein the process further comprises:

maintaining a uniform temperature over the entire surface of the top head member facing the interior of the mould; and slowly lowering the temperature of the top head member in conjunction with the lowering of the temperature of the bottom head member.

3. The process of claim 2, wherein the lowering of the temperature of the top head member starts after the lowering of the temperature of the bottom head member.

4. The process of claim 1 or claim 2, further comprising heating the vertical walls of the mould to compensate for heat loss from the mould to the environment.

5. The process of claim 7, further comprising:

removing the solidified explosive body from the mould; and machining the body to form a recess in its bottom surface for receiving a liner of a hollow-explosive charge.

6. A process for preparing a circular cylindrical explosive casting, to be used for making a hollow charge, said casting being symmetrical around its longitudinal axis as regards distribution of density, composition and content of pores, by vacuum casting of an explosive material mixture comprising a liquid, melted phase, and solid components having a higher density than the liquid phase and dispersed therein, said process comprising:

stirring the explosive material mixture at a temperature higher than the ambient temperature for a predetermined time to homogenize the mixture;

rapidly transferring the homogenized mixture to a circular cylindrical mould with vertical axis;

maintaining a thermal equilibrium between the different parts of the mixture for a predetermined period of time to allow the solid components to settle to a steady state without being influenced by other forces than gravity;

lowering the temperature of the mould in a controlled manner to solidify the mixture by moving a solidification front very slowly from the bottom and walls of the mould in a direction upwards and inwards, while maintaining a temperature distribution within said mixture that is at an instant symmetrical around the vertical axis of the mould;

slowly cooling the solidified casting in a controlled manner to ambient temperature;

removing the casting from the mould; and machining the casting to desired dimensions including the removal of an upper part of the casting and the machining of a recess for a liner.

7. A process for preparing a circular cylindrical explosive casting, to be used for making a hollow charge, said casting being symmetrical around its longitudinal axis as regards distribution of density, composition and content of pores, by vacuum casting of an explosive material mixture comprising a liquid, melted phase, and solid components having a higher density than the liquid phase and dispersed therein, said process comprising:

stirring the explosive material mixture at a temperature higher than the ambient temperature for a predetermined time to homogenize the mixture;

rapidly transferring the homogenized mixture to a plurality of parallel, circular cylindrical moulds with vertical axes;

maintaining a thermal equilibrium between the different parts of the mixture for a predetermined period of time to allow the solid components to settle to a steady state without being influenced by other forces than gravity;

lowering the temperatures of the moulds in a controlled manner to solidify the mixture by moving a solidification front very slowly from the bottom and walls of the moulds in a direction upwards and inwards, while maintaining a temperature distribution within said mixture that is at any instant symmetrical around the vertical axis of a respective one of each of the moulds;

slowly cooling the solidified castings in a controlled manner to ambient temperature;

removing the castings from the moulds; and machining each of the castings to desired dimensions including the removal of an upper part of each casting and the machining of a recess for a liner.

* * * * *